United States Patent [19]

Shapiro

[11] 4,395,295

[45] Jul. 26, 1983

[54] PROCESS FOR TREATING COPPER-ALUMINUM-SILICON ALLOYS TO IMPROVE FATIGUE STRENGTH

[75] Inventor: Eugene Shapiro, Hamden, Conn.

[73] Assignee: Olin Corporation, New Haven, Conn.

[21] Appl. No.: 382,865

[22] Filed: May 28, 1982

[51] Int. Cl.[3] ..... C22F 1/08

[52] U.S. Cl. ..... 148/11.5 C; 148/12.7 C; 148/411

[58] Field of Search ..... 148/11.5 C, 12.7 C, 148/411

[56] References Cited

U.S. PATENT DOCUMENTS

| | | |
|---|---|---|
| 1,955,576 | 4/1934 | Clapp et al. . |
| 2,676,123 | 4/1954 | Gregory . |
| 3,663,311 | 5/1972 | Chin et al. . |
| 3,841,921 | 10/1974 | Shapiro et al. . |
| 3,855,012 | 12/1974 | Shapiro et al. . |
| 3,882,712 | 5/1975 | Shapiro et al. . |
| 4,025,367 | 5/1977 | Parikh et al. . |
| 4,047,978 | 9/1977 | Parikh et al. . |
| 4,055,445 | 10/1977 | Pops . |
| 4,226,621 | 10/1980 | Ruchel . |
| 4,233,068 | 1/1980 | Smith, Jr. et al. . |
| 4,238,249 | 12/1980 | Ruchel . |
| 4,288,257 | 9/1981 | Ruchel . |

OTHER PUBLICATIONS

"Stress Relaxation and Fatigue of Two Electromechanical Spring Materials Strengthened by Thermomechanical Processing", by A. Fox, *I.E.E.E. Transactions on Parts, Materials and Packing*, vol. 7, No. 1, 1971, pp. 34–47.

*Primary Examiner*—Peter K. Skiff
*Attorney, Agent, or Firm*—Barry L. Kelmachter; Howard M. Cohn; Paul Weinstein

[57] ABSTRACT

A process for improving the fatigue strength and fatigue life of a substantially single phase copper-aluminum-silicon alloy is described. The process comprises cold working the copper alloy from about 75% to about 98% and heating the alloy at a temperature of about 200° C. to about 350° C. for a time period of at least about 5 minutes.

8 Claims, No Drawings

PROCESS FOR TREATING COPPER-ALUMINUM-SILICON ALLOYS TO IMPROVE FATIGUE STRENGTH

This invention relates to a process for improving the fatigue strength and fatigue life of copper-aluminum-silicon alloys.

High fatigue strength is an important performance characteristic in electrical relays, high speed machinery, rotating parts and other applications which undergo flexion or cyclical stresses. Conventionally,the fatigue strength of material is increased by cold working. Usually, this only is effective to a certain level beyond which a saturation occurs and the fatigue strength no longer improves. Consequently, cold working beyond 60% is not normally used to improve fatigue performance. In some instances, increases in cold working have actually caused fatigue strength to decrease.

Within the prior art, processes utilizing combinations of cold working and low temperature heat treatment have been used to enhance the fatigue strength of two-phase copper alloy systems. As used herein, the phrase two-phase copper alloy means an alloy having alpha-phase material and beta-phase material. Typically, such cold working is performed at a level in the range of about 65% to about 95%. Following the cold working, a low temperature heat treatment usually in the temperature range of about 250° C. to about 300° C. for a period between about 4 hours and about 9 hours is performed. This low temperature heat treatment increases the amount of beta-phase material at the expense of the alpha-phase material. U.S. Pat. Nos. 4,055,455 to Pops and 4,266,621 to Ruchel illustrate processes for enhancing the fatigue strength of two-phase copper alloy systems. The different mechanisms involved in two-phase copper alloy systems distinguishes them from single-phase copper alloy systems such as the substantially alpha-matrix phase alloy of the instant invention.

It has also been suggested in the prior art that the fatigue strength and stress relaxation behavior of copper alloys such as C51000 and C72500 may be enhanced by processing the alloys using a combination of cold working at a relatively high level and heat treating at relatively low temperatures. Such a process is illustrated in the article "Stress Relaxation and Fatigue of Two Electromechanical Spring Materials Strengthened By Thermomechanical Processing" by A. Fox, *I.E.E.E. Transactions on Parts, Materials and Packing,* Vol. 7, No. 1, 1971, pp. 34–47.

Processes using combinations of relatively high levels of cold working and relatively low temperature heat treatments have been used to enhance various properties of copper alloys. These properties include hardness, tensile strength, yield strength, deformability, grain structure and stress relaxation. U.S. Pat. Nos. 1,955,576 to Clapp et al., 2,676,123 to Gregory, 3,663,311 to Chin et al., 4,238,249 and 4,288,257 both to Ruchel and 4,233,068 to Smith, Jr. et al. exemplify such processes for enhancing the properties of various copper alloy systems.

A particular family of copper alloys that have frequently been mentioned as being suitable for use as electrical connectors and the like are those copper alloys having low stacking fault energy. Copper alloy C63800 is one of the alloys within this family. Processes using various combinations of cold working and heat treatments have been used to improve such properties of C63800 as creep resistance, stress relaxation resistance, thermal stability, yield strength and bending. These processes are illustrated by U.S. Pat. Nos. 3,841,921 to E. Shapiro et al., 3,855,012 and 3,882,712 both to S. Shapiro et al., and 4,025,367 and 4,047,978 both to Parikh et al.

Heretofore, it has not been recognized that the use of a critical combination of low temperature heat treatment in combination with a relatively high reduction cold working step significantly enhances the fatigue strength, in both the longitudinal and transverse directions, of copper-aluminum-silicon alloys such as C63800. In addition, components made from an alloy processed in accordance with the instant invention exhibit an increased fatigue life relative to other high strength copper alloys.

In accordance with this invention, a process has been developed for improving the fatigue strength and the fatigue life of single phase copper-aluminum-silicon alloys. The alloys to which this invention is applicable contain from about 1% to about 5% silicon and from about 2% to 12% aluminum. The alloys may also contain at least one additional element if so desired. Preferred ranges for the various elements are specified in the detailed description.

In accordance with this invention, the alloys are cold worked from about 75% to about 98% and then subjected to a final heat treatment at a temperature in the range of about 200° C. to about 350° C. for a time period of at least about 5 minutes. The alloys as thus treated have improved fatigue strength and fatigue life.

In a preferred embodiment of the instant invention, the alloys are cold worked from about 80% to about 90% and heated to a temperature in the range of about 250° C. to about 300° C. for a time period of about 30 minutes to about 24 hours. Preferably, the cold working is performed in a single step and the heat treatment is performed in a single step.

In accordance with another embodiment of this invention, intermediate cold working and annealing steps may be interposed before the aforenoted cold working step and final heat treatment.

Accordingly, it is an object of this invention to provide a process for improving the fatigue strength and the fatigue life of a substantially single phase or substantially alpha-matrix phase copper-aluminum-silicon alloys.

It is a further object of this invention to provide a process as above including a critical combination of a high reduction cold working step followed by a final relatively low temperature heat treatment which provides said improvements.

Other objects and advantages will become apparent to those skilled in the art from the ensuing detailed description.

In accordance with the process of this invention, an alloy consisting essentially of about 1% to about 5% silicon, from about 2% to about 12% aluminum and the balance essentially copper is provided. If desired, the alloy may contain one or more additional elements such as up to 1% cobalt, up to 1% iron, up to 1% chromium and mixtures thereof. The alloy thus provided is cold worked from about 75% to about 98%, and preferably from about 80% to about 90%, and is then subjected to a final low temperature thermal treatment which comprises heating the alloy to a temperature of from about 200° C. to about 350° C., and preferably from about 250° C. to about 300° C. Thereafter, the alloy is preferably cooled to room temperature. The heat up and cool down rates for the final low temperature heat treatment are not a critical aspect of this invention and conventional practices may be followed. For the final low temperature heat treatment, the alloy is held at temperature for at least five minutes and preferably for a time period of about 30 minutes to about 24 hours. In a preferred manner, each of the cold working and the final heat treatment steps are performed in a single operation. For example, the cold working could be carried out by a single pass through a tandem rolling mill or a reversing mill and the heat treatment could be carried out in a single pass through any conventional furnace.

Preferably, the alloy consists essentially of about 1% to about 3.5% silicon, about 2% to about 10% aluminum and the balance essentially copper. The alloy also preferably comprises a single phase, substantially alpha-matrix alloy. It is believed that the addition of some elements may cause a dispersed phase.

In accordance with another embodiment of this invention, one or more series of cold working and intermediate annealing steps may be employed prior to the critical cold working and relatively low temperature heat treatment combination set out above. In this embodiment, the alloys are provided as in accordance with the previous embodiment and are then cold worked from about 10% to about 97% and preferably from about 15% to about 95%, followed by intermediate annealing for at least one minute at a temperature of from about 300° C. to about 750° C. so as to recrystallize the alloys, and preferably from about 350° C. to about 700° C. This intermediate series of cold working and annealing steps may be repeated as desired to obtain the desired gage and temper in the final material.

Following the intermediate annealing step, the alloy is processed as in the previous embodiment; namely, it is cold rolled from about 75% to about 98% and preferably from about 80% to about 90%, and then heated from a temperature of about 200° C. to about 350° C., and preferably from about 250° C. to about 300° C. Thereafter, the alloy may be cooled to room temperature.

After the final low temperature heat treatment, the alloy may be formed into any desired article such as a flexible contact member for use in a high speed ink jet printer. Any suitable technique may be used to form the alloy into the desired article. After being formed into the desired article, the desired article may undergo additional processing such as further heat treatment.

The invention will now be illustrated by reference to specific examples.

EXAMPLE I

Table I below shows fatigue strength vs. cold working and heat treatment for copper alloy C63800 which consists essentially of 2.5% aluminum, 1.9% silicon, 0.25% to 0.55% cobalt, balance copper. A first sample of copper alloy C63800 was obtained as production strip at 0.04" gage cold rolled 50%. A second sample of copper alloy C63800 was obtained as commercially hot rolled plate and cold rolled 90%. The samples were given a final low temperature anneal at about 300° C. for about 1 hour. The annealed samples and samples without any final low temperature heat treatment were subjected to fatigue tests.

TABLE I

| % CR | Final Anneal | Longitudinal Fatigue Strength at $10^8$ Cycles ksi | Transverse Fatigue Strength at $10^8$ Cycles ksi |
|---|---|---|---|
| 50 | — | 34 | — |
| 50 | 300° C. | 33 | — |
| 90 | — | 31 | 46 |
| 90 | 300° C. | 45 | 58 |

The fatigue tests were done in completely reverse bending, zero mean stress, to define the fatigue strength. As used herein, the term fatigue strength is the stress which the material can withstand at $10^8$ cycles of bending. The results of the test are tabulated in Table I.

The data show that increasing reduction from 50% to 90% without a heat treatment does not increase fatigue strength measured in the longitudinal direction. The data also show that the use of low temperature heat treatment dramatically increases fatigue strength in both longitudinal and transverse directions when combined with a relatively high reduction. For example, at 50% cold reduction, heat treatment decreases longitudinal fatigue strength from 34 ksi to 33 ksi. At 90% reduction, heat treatment increases longitudinal fatigue strength from 31 ksi to 45 ksi and increases transverse fatigue strength from 46 ksi to 58 ksi. The data in Table I can be said to show that critical combinations of cold working and final low temperature heat treatments in accordance with this invention improve the fatigue strength of the alloy.

EXAMPLE II

Table II shows fatigue life vs. cold working for copper alloy C63800 subjected to a final low temperature anneal. A sample of copper alloy C63800 was obtained as commercial strip at 0.078" gage soft. This metal was processed to three different gages of 0.017", 0.030" and 0.060". Each was annealed at about 500° C. for about 1 hour, cleaned and then rolled to 0.006" gage. All were given a final low temperature anneal at about 275° C. for about 1 hour.

TABLE II

| % CR | Final Anneal | Fatigue Life, ksi |
|---|---|---|
| 65 | 275° C. | 4 MM |
| 80 | 275° C. | >10 MM |
| 90 | 275° C. | >28 MM |

The data tabulated in Table II show that increasing the amount of reduction for a given final heat treatment increases the fatigue life of the alloy. Comparison was made against beryllium-copper which is recognized as an outstanding alloy for fatigue resistance. In a similar test, beryllium-copper lasts 8 million cycles or 8 MM. The increased fatigue life of this alloy reflects the increase in fatigue strength. Again, the data shown in Table II can be said to show that critical combinations of cold working and final low temperature heat treatments in accordance with this invention improve the fatigue life and fatigue strength of the alloy.

EXAMPLE III

Table III below shows that cold working and final low temperature heat treatments in accordance with this invention do not substantially degrade the tensile and yield strengths of the alloy. In fact, at higher reductions, the final low temperature heat treatment significantly increases both the tensile and yield strengths of the alloy.

TABLE III

| % CR | Final Anneal | Longitudinal U.T.S. ksi | Longitudinal 0.2 Y.S. ksi | Transverse U.T.S. ksi | Transverse 0.2 Y.S. ksi |
|---|---|---|---|---|---|
| 50 | — | 127 | 106 | — | — |
| 50 | 300° C. | 129 | 112 | — | — |
| 65 | 275° C. | 139 | 121 | — | — |
| 80 | 275° C. | 140 | 120 | — | — |
| 90 | — | 129 | 111 | 147 | 121 |
| 90 | 275° C. | 136 | 120 | — | — |
| 90 | 300° C. | 142 | 130 | 173 | 156 |

The tensile properties were measured in the conventional way recording ultimate strengths and 0.2% offset yield strength.

While the invention has been described with reference to alloy C63800, it is particularly applicable to a wide variety of copper-aluminum-silicon alloys.

The above examples establish that critical combinations of cold working and final low temperature heat treatment in accordance with this invention improve the fatigue strength and fatigue life of a wide variety of copper-aluminum-silicon alloys such as C63800 without substantially degrading the tensile properties of the alloys.

The patents and publication set forth in the specification are intended to be incorporated by reference herein.

It is apparent that there has been provided in accordance with this invention a process for treating copper-aluminum-silicon alloys to improve fatigue strength which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A process for providing a substantially single phase copper alloy having a fatigue strength in a longitudinal direction substantially in excess of about 31 ksi and in a transverse direction substantially in excess of about 46 ksi and having a fatigue life of at least about 10 million cycles, said process comprising:

providing a copper alloy consisting essentially of from about 1% to about 5% silicon, from about 2% to about 12% aluminum and the balance essentially copper;

cold working said alloy from about 80% to about 90%; and heating said alloy at a temperature of about 250° C. to about 300° C. for a time period of about 30 minutes to about 24 hours.

2. The process of claim 1 further comprising:

said cold working step comprising rolling said alloy in a single pass.

3. The process of claim 1 further comprising:

said copper alloy providing step comprising providing a copper alloy consisting essentially of about 1% to about 5% silicon, from about 2% to about 12% aluminum, up to about 1% of at least one additional element selected from the group consisting of iron, cobalt, chromium and mixtures thereof, and the balance essentially copper.

4. The process of claim 1 further comprising:

said copper alloy providing step comprising providing a copper alloy consisting essentially of about 2.5% aluminum, about 1.9% silicon, about 0.25% to about 0.55% cobalt and the balance essentially copper.

5. The process of claim 1 including the following steps prior to said cold working step:

cold working said alloy from about 10% to 97%; and heating said alloy to a temperature from about 300° C. to about 750° C. for at least one minute so as to recrystallize said alloy.

6. The process of claim 1 further comprising:

forming said heat treated alloy into a desired article.

7. The product formed by the process of claim 1.

8. A flexible contact member for an ink jet printer, said contact member comprising:

a member formed from a copper alloy, said copper alloy consisting essentially of from about 1% to about 5% silicon, from about 2% to about 12% aluminum and the balance essentially copper and having a fatigue strength in a longitudinal direction substantially in excess of about 31 ksi and in a transverse direction substantially in excess of about 46 ksi and a fatigue life of at least about 10 million cycles from being cold worked from about 80% to about 90% and being subjected to a final heat treatment at a temperature of about 250° C. to about 300° C. for a time period of about 30 minutes to about 24 hours.

* * * * *